US011518179B2

(12) United States Patent
Shinada

(10) Patent No.: US 11,518,179 B2
(45) Date of Patent: Dec. 6, 2022

(54) PRINTING APPARATUS AND CONTROL METHOD FOR PRINTING APPARATUS

(71) Applicant: SEIKO EPSON CORPORATION, Tokyo (JP)

(72) Inventor: Ryosuke Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/305,960

(22) Filed: Jul. 19, 2021

(65) Prior Publication Data

US 2022/0024216 A1 Jan. 27, 2022

(30) Foreign Application Priority Data

Jul. 21, 2020 (JP) ..... JP2020-124226

(51) Int. Cl.
*B41J 2/175* (2006.01)

(52) U.S. Cl.
CPC ..... *B41J 2/17566* (2013.01)

(58) Field of Classification Search
CPC ..... B41J 2/17566; B41J 2/175
See application file for complete search history.

(56) References Cited

U.S. PATENT DOCUMENTS 9,150,011 B1 * 10/2015 Tomoguchi ..... B41J 2/17566
2014/0292965 A1 10/2014 Hamamoto

FOREIGN PATENT DOCUMENTS

JP 2014-188790 A 10/2014

* cited by examiner

*Primary Examiner* — Bradley W Thies
(74) *Attorney, Agent, or Firm* — Workman Nydegger

(57) ABSTRACT

A printing apparatus includes a main storage unit for storing ink, an auxiliary tank, a head supply tank, a main pump, and a first ink amount detector for detecting an amount of the ink stored in the auxiliary tank. The printing apparatus drives the main pump to transport the ink from the main storage unit to the auxiliary tank, measures a time required for the amount of the ink stored in the auxiliary tank to reach a first target amount, and determines a settling state of the ink based on the measured time.

10 Claims, 6 Drawing Sheets

PRINTING APPARATUS AND CONTROL METHOD FOR PRINTING APPARATUS

The present application is based on, and claims priority from JP Application Serial Number 2020-124226, filed Jul. 21, 2020, the disclosure of which is hereby incorporated by reference herein in its entirety.

BACKGROUND

1. Technical Field

The present disclosure relates to a printing apparatus and a control method of the printing apparatus.

2. Related Art

In a printing apparatus that discharges ink from a head to form an image, when using ink containing a sedimented substance such as a pigment, there is a possibility that components of the ink settle in an ink container. Therefore, recently, in order to suppress sedimentation of the components of the ink, it has been recommended that a user removes the ink container from the printing apparatus and agitate the ink in the ink container. In addition, a printing apparatus having a function of suppressing sedimentation of the components of the ink has been proposed (see, for example, JP-A-2014-188790). The printing apparatus described in JP-A-2014-188790 includes a mechanism for moving the ink container, and includes a function of shaking the ink container mounted at the printing apparatus.

When ink sedimentation occurs in the ink container mounted at the printing apparatus, the ink container needs to be shaken by a configuration described in JP-A-2014-188790, or the user needs to remove the ink container from the printing apparatus and shake the ink container. Therefore, there is a desire for a method for determining whether the sedimentation of the components of the ink occurs while the ink container is mounted at the printing apparatus.

SUMMARY

An aspect for solving the above-described problem is a printing apparatus configured to form an image on a printing medium, the printing apparatus including: a printing head configured to discharge ink; a first ink storage unit configured to store the ink; a second ink storage unit disposed in a flow path configured to transport ink from the first ink storage unit to the printing head, and store the ink delivered from the first ink storage unit; a third ink storage unit disposed in a flow path configured to transport the ink from the second ink storage unit to the printing head, and store the ink; a first transport unit configured to transport the ink from the first ink storage unit to the second ink storage unit; a first detector configured to detect an amount of the ink stored in the second ink storage unit; a measurement unit configured to measure a time required to transport the ink; and a control unit configured to perform a determination process for determining a settling state of the ink stored in the first ink storage unit, wherein the control unit is configured to drive, in the determination process, the first transport unit to transport the ink from the first ink storage unit to the second ink storage unit, measure, by the measurement unit, a time required for the amount of the ink stored in the second ink storage unit to reach a first target amount, and determine the settling state of the ink based on a time measured by the measurement unit.

Another aspect for solving the above problem includes a control method for a printing apparatus, the method including: controlling the printing apparatus including a printing head configured to discharge ink, a first ink storage unit configured to store the ink, a second ink storage unit disposed in a flow path configured to transport ink from the first ink storage unit to the printing head, and store the ink delivered from the first ink storage unit, a third ink storage unit disposed in a flow path configured to transport the ink from the second ink storage unit to the printing head, and store the ink, a first transport unit configured to transport the ink from the first ink storage unit to the second ink storage unit, and a first detector configured to detect an amount of the ink stored in the second ink storage unit; driving the first transport unit to transport the ink from the first ink storage unit to the second ink storage unit; measuring a time required for the amount of the ink stored in the second ink storage unit to reach a first target amount with the transported ink; and performing a determination process for determining, based on the measured time, a settling state of the ink stored in the first ink storage unit.

DESCRIPTION OF EXEMPLARY EMBODIMENTS

1. Overall Configuration of Printer

Hereinafter, exemplary embodiments to which the present disclosure has been applied will be described with reference to the drawings.

Figure 1:
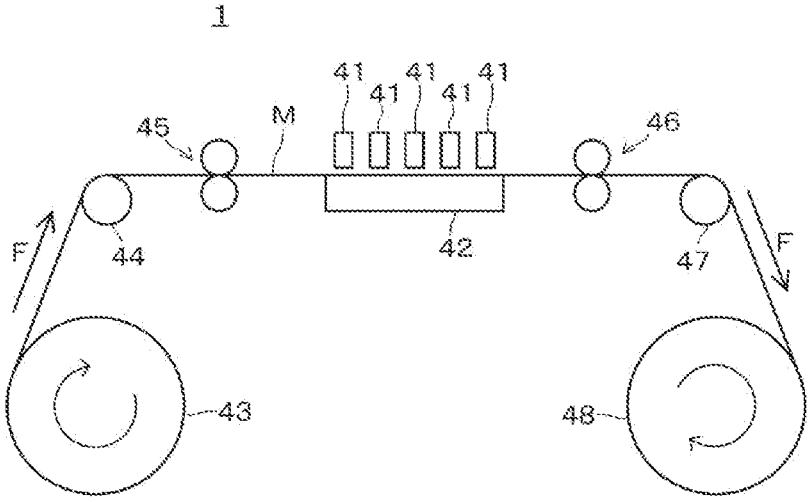
FIG. 1 is a diagram illustrating a schematic configuration of a printer according to an exemplary embodiment of the present disclosure.

FIG. 1 is a plan view illustrating a schematic configuration of a printer 1 according to the present exemplary embodiment.

The printer 1 is an ink-jet type printing apparatus that discharges ink onto a printing medium M to form an image on a print surface of the printing medium M. The printer 1 includes a printing head 41 that discharges ink onto the printing medium M. The printing head 41 is provided for each color of the ink used by the printer 1. FIG. 1 illustrates a configuration including five printing heads 41 corresponding to five color ink of yellow, magenta, cyan, black, and white. However, a number of colors of the ink used by the printer 1 is not particularly limited.

A platen 42 supporting the printing medium M is disposed at a position facing the printing head 41.

The printing medium M is not particularly limited as long as the printing medium M has a sheet shape, for which paper, synthetic resin sheet, fabric, etc. can be used. The printing medium M may be a cut sheet that has been cut to a regular size, but in the present exemplary embodiment, a configuration using a long printing medium M will be described as an example.

The printer 1 has a feeding roller 43 onto which the printing medium M is wound in a roll shape. The printer 1 includes a transport unit that transports the printing medium M extracted from the feeding roller 43 in a transport direction F. The transport unit includes, for example, a relay roller 44, a transport roller 45, a transport roller 46, and a relay roller 47 illustrated in FIG. 1. The transport roller 45 nips the printing medium M with a pair of rollers, and feeds the printing medium M in the transport direction F by the power of a transport motor (not illustrated). The printing medium M printed by the printing head 41 is wound onto a winding roller 48.

Ink is supplied to the printing head 41 by an ink supply mechanism described below in FIG. 2. The printing head 41 has a nozzle (not illustrated) facing the platen 42 and a pressurizing mechanism (not illustrated) that pressurizes the ink. The operation of this pressing mechanism causes ink to be discharged from the nozzle. At this time, negative pressure is generated within the printing head 41 due to the operation of the pressurizing mechanism. The printing head 41 sucks the ink by this negative pressure.

2. Configuration of Ink Supply Mechanism

Figure 2:
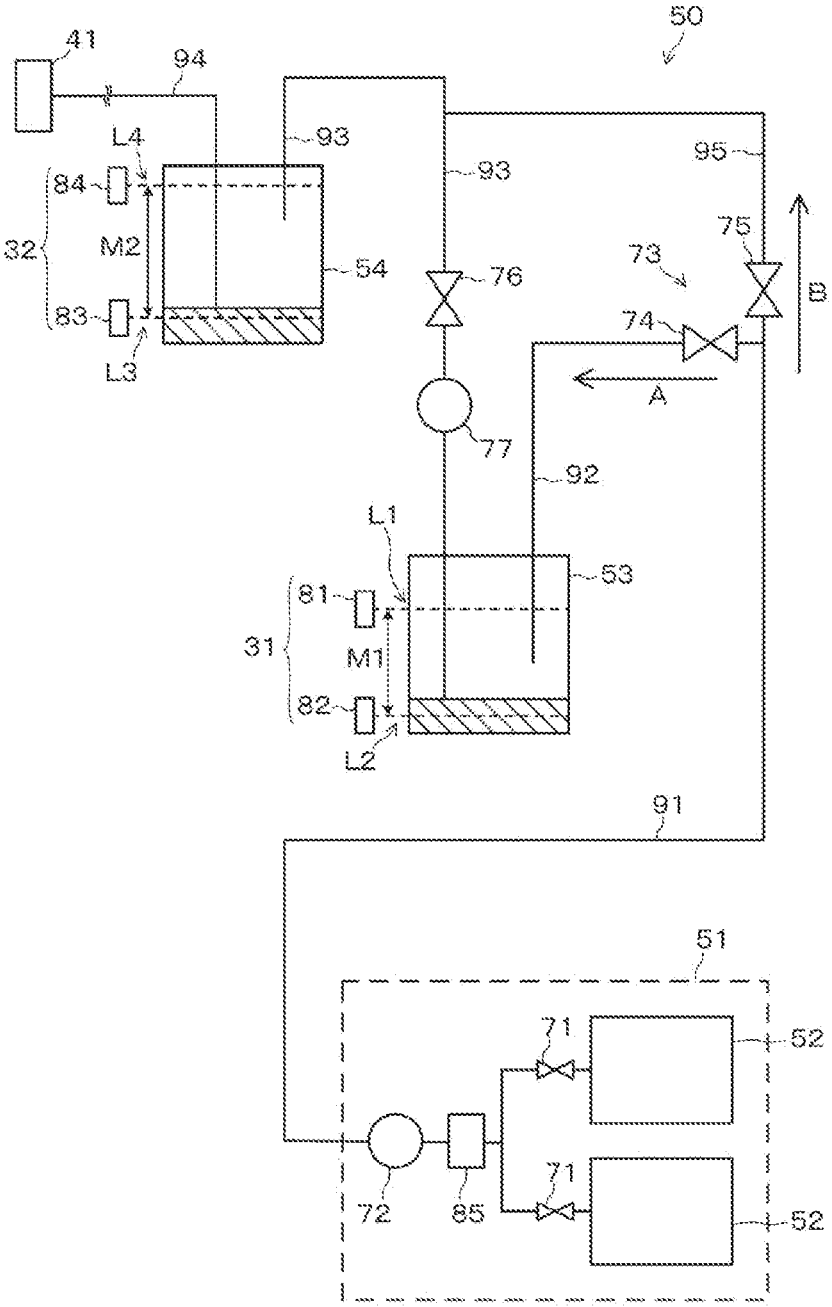
FIG. 2 is a diagram illustrating a configuration of an ink supply mechanism for the printer.

FIG. 2 is a diagram illustrating a configuration of an ink supply mechanism 50 of the printer 1. FIG. 2 is a diagram schematically illustrating a configuration related to ink supply and storage. The specific shape and size of each unit included in the ink supply mechanism 50 is not limited to FIG. 2. The printer 1 includes one ink supply mechanism 50, corresponding to one ink color. For example, the printer 1 using five color inks as illustrated in FIG. 1 includes five ink supply mechanisms 50 corresponding to each color ink. The configuration of the ink supply mechanism 50 corresponding to each color is common.

The printer 1 includes a main storage unit 51, an auxiliary tank 53, and a head supply tank 54 as storage units for storing ink. The main storage unit 51 corresponds to an example of a first ink storage unit, the auxiliary tank 53 corresponds to an example of a second ink storage unit, and the head supply tank 54 corresponds to an example of a third ink storage unit.

An ink pack 52 is mounted at the main storage unit 51. The ink pack 52 is an ink container in which ink is encapsulated, and is detachable from the main storage unit 51. By mounting the ink pack 52 to the main storage unit 51, the printer 1 can be replenished with ink. In the configuration illustrated in FIG. 2, a plurality of the ink packs 52 can be mounted in the main storage unit 51. When the ink in any one of the ink packs 52 is empty, the ink pack 52 can be replaced without deactivating the printer 1.

The main storage unit 51 includes valves 71, 71 attached to a tube leading to the ink pack 52. Each valve 71 is an opening/closing valve to close a path of ink flow when the ink pack 52 is removed. The main storage unit 51 includes a main storage unit ink sensor 85. The main storage unit ink sensor 85 detects a residual amount of the ink in the ink pack 52 mounted in the main storage unit 51. For example, the main storage unit ink sensor 85 detects that the residual amount of the ink in any ink pack 52 mounted in the main storage unit 51 falls below a preset amount.

As a transport path for transporting the ink, an ink supply tube 91 is coupled to the main storage unit 51. The ink supply tube 91 leads to an ink supply tube 92 and a bypass tube 95. The ink supply tube 92 is a tube that supplies ink transported through the ink supply tube 91 to the auxiliary tank 53. The main storage unit 51 includes a main pump 72 that delivers the ink to the ink supply tube 91. Driving the main pump 72 causes the ink accommodated in the ink pack 52 to be delivered to the ink supply tube 91. The main pump 72 corresponds to an example of the first transport unit.

The auxiliary tank 53 temporarily stores the ink flowing therein through the ink supply tube 92. The auxiliary tank 53 is coupled to the head supply tank 54 through an ink supply tube 93. An auxiliary pump 77 is disposed in the ink supply tube 93, and driving the auxiliary pump 77 causes the ink stored in the auxiliary tank 53 to be transported through the ink supply tube 93 to the head supply tank 54. The auxiliary pump 77 corresponds to an example of the second transport unit.

The head supply tank 54 temporarily stores the ink flowing therein through the ink supply tube 93. The head supply tank 54 is coupled to the printing head 41 through a suction tube 94. When the printing head 41 sucks the ink in conjunction with the operation of ink discharge, the ink is supplied from the head supply tank 54 through the suction tube 94 to the printing head 41. The printer 1 can smoothly supply ink to the printing head 41 by storing ink in the head supply tank 54.

The ink supply mechanism 50 includes the bypass tube 95 that couples the ink supply tube 91 and the ink supply tube 93. The bypass tube 95 functions as a transport path for transporting ink from the main storage unit 51 to the head supply tank 54 without passing through the ink supply tube 93.

As a configuration for switching the ink transport path, the ink supply mechanism 50 includes a switching unit 73 and a valve 76. The switching unit 73 is a valve for switching an ink supply destination from the ink supply tube 91 to the ink supply tube 92 and the bypass tube 95, and is provided at a coupling point between the ink supply tube 91, the ink supply tube 92, and the bypass tube 95. The switching unit 73 may be a configuration provided with, for example, a valve 74 that opens and closes the ink supply tube 92, and a valve 75 that opens and closes the bypass tube 95. In this case, by opening and closing the valves 74, 75 that are opening/closing valves, the transport destination of the ink delivered by the main pump 72 can be switched to the auxiliary tank 53 and the head supply tank 54. The configuration of the switching unit 73 can be modified as desired, and may be, for example, one three way valve that switches between the ink supply tube 92 and the bypass tube 95 and couples to the ink supply tube 91. The switching unit 73 corresponds to an example of a switching mechanism.

The valve 76 is disposed in the ink supply tube 93. The valve 76 is an opening/closing valve, and the ink supply tube 93 can be closed such that the ink flowing into the ink supply tube 93 from the bypass tube 95 does not flow toward the auxiliary tank 53. It is sufficient that the valve 76 can prevent flow of the ink toward the auxiliary tank 53. The valve 76 may be a check valve, for example.

In this manner, the ink supply mechanism 50 supplies ink from the main storage unit 51 through the auxiliary tank 53 to the head supply tank 54. In this case, the valve 75 of the switching unit 73 is closed, the valve 74 is opened, and then the ink flows from the ink supply tube 91 to the ink supply tube 92. The ink path in this case is referred to as a supply path A. Further, the ink supply mechanism 50 transports ink from the ink supply tube 91 to the bypass tube 95 by opening the valve 75 of the switching unit 73 and closing the valve 74. The ink path in this case is referred to as a supply path B. The supply path B corresponds to a bypass path.

The ink supply mechanism 50 includes a first ink amount detector 31, a second ink amount detector 32, and a main storage unit ink sensor 85 as sensors for detecting an amount of the ink. The first ink amount detector 31 corresponds to an example of a first detector, and the second ink amount detector 32 corresponds to an example of a second detector.

The first ink amount detector 31 is a unit that detects the amount of the ink stored in the auxiliary tank 53. The first ink amount detector 31 may have a configuration capable of detecting the amount of the ink stored in the auxiliary tank 53, while it is sufficient that the first ink amount detector 31 be configured to detect whether or not the amount of the ink is equal to or greater than a first target amount L1, and whether or not the amount of the ink is equal to or greater than a second target amount of L2. In the present exemplary embodiment, the first ink amount detector 31 includes a first sensor 81 that detects that the amount of the ink is equal to or greater than the first target amount L1, and a second sensor 82 that detects that the amount of the ink is equal to or greater than the second target amount L2. The first sensor 81 is, for example, an optical sensor that optically detects the presence or absence of the ink at a liquid level position of the first target amount L1. The second sensor 82 may also employ an optical sensor. Here, the first ink amount detector 31 can be configured to employ a weight sensor. For example, the first ink amount detector 31 may be configured to include one or more weight sensors instead of the first sensor 81 and the second sensor 82.

The second ink amount detector 32 is a unit that detects the amount of the ink stored in the head supply tank 54. The second ink amount detector 32 may have a configuration capable of detecting the amount of the ink stored in the head supply tank 54, but at least a configuration capable of detecting whether or not the amount of the ink is equal to or greater than a fourth target amount L4, and whether or not the amount of the ink is equal to or greater than a third target amount L3. In the present exemplary embodiment, the second ink amount detector 32 includes a fourth sensor 84 that detects that the amount of the ink is equal to or greater than the fourth target amount L4, and a third sensor 83 that detects that the amount of the ink is equal to or greater than the third target amount L3. The fourth sensor 84 is, for example, an optical sensor that optically detects the presence or absence of the ink at a liquid level position of the fourth target amount L4. The third sensor 83 may also employ an optical sensor. Here, the second ink amount detector 32 can be configured to employ a weight sensor. For example, the second ink amount detector 32 may be configured to include one or more weight sensors instead of the third sensor 83 and the fourth sensor 84.

The main storage unit ink sensor 85 is a sensor that detects the residual amount of the ink in the ink pack 52 mounted in the main storage unit 51, and a weight sensor can be used therefor, for example.

The auxiliary tank 53 is used in processing for the printer 1 to determine a settling state of the components of the ink. The printer 1 may utilize ink including a pigment component. For example, white ink is the ink for printing white as the background color of a color image, and contains a white pigment that is sedimented. Examples of white pigments include metal oxides, barium sulfate, calcium carbonate, etc. Examples of the metal oxide include titanium dioxide, zinc oxide, silica, alumina, magnesium oxide, etc. As for yellow, cyan, magenta, and black colors, or other color ink, a pigment ink can be used in which a liquid as a base material with pigment is dispersed as a color agent. Such ink has a property of settling the color agent over time, and is referred to as sedimented ink.

When the pigment included in the ink settles, the ink supplied to the printing head 41 contains a large amount of a base agent, and thus the content of the pigment is reduced. Thus, viscosity of the ink flowing through the ink supply mechanism 50 is reduced. Therefore, in the present exemplary embodiment, by measuring the viscosity of the ink, a state in which the pigment settles in the ink, i.e., the settling state of the ink, is detected.

Specifically, the printer 1 transports the ink from the main storage unit 51 to the auxiliary tank 53, determines a time required for a predetermined amount of the ink to be stored in the auxiliary tank 53, and utilizes this time as an indicator of the viscosity of the ink. Here, the predetermined amount is an ink amount M1 that is a difference between the second target amount L2 and the first target amount L1 in the present exemplary embodiment, in which the following condition is satisfied: the second target amount L2<the first target amount L1.

On the other hand, the head supply tank 54 is a tank for storing ink for smoothly supplying ink to the printing head 41. The printer 1 performs control so that the ink in the head supply tank 54 is not insufficient. Specifically, the third target amount L3 is set as an indicator for replenishing the head supply tank 54 with ink. When the ink amount falls below the third target amount L3, the ink is replenished to the head supply tank 54. In this case, when the ink amount of the head supply tank 54 reaches the fourth target amount L4, the replenishment is complete. In other words, the head supply tank 54 is supplied with ink with an ink amount M2 corresponding to a difference between the fourth target amount L4 and the third target amount L3 in a single replenishment operation.

Here, the ink amount M2 in the head supply tank 54 is greater than the ink amount M1 in the auxiliary tank 53. Thus, when the ink amount in the head supply tank 54 reaches the third target amount L3 after the ink amount of the auxiliary tank 53 reaches the first target amount L1, the ink in the auxiliary tank 53 can be transported to the head supply tank 54 until the ink amount reaches the second target amount L2. As a result, in a case where the process for determining the settling state of the ink is not performed, the amount of the ink stored in the auxiliary tank 53 can be minimized. When the ink amount in the auxiliary tank 53 is small, the printer 1 supplies the ink from the main storage unit 51 through the bypass tube 95 to the head supply tank 54.

3. Control System of Printer

Figure 3:
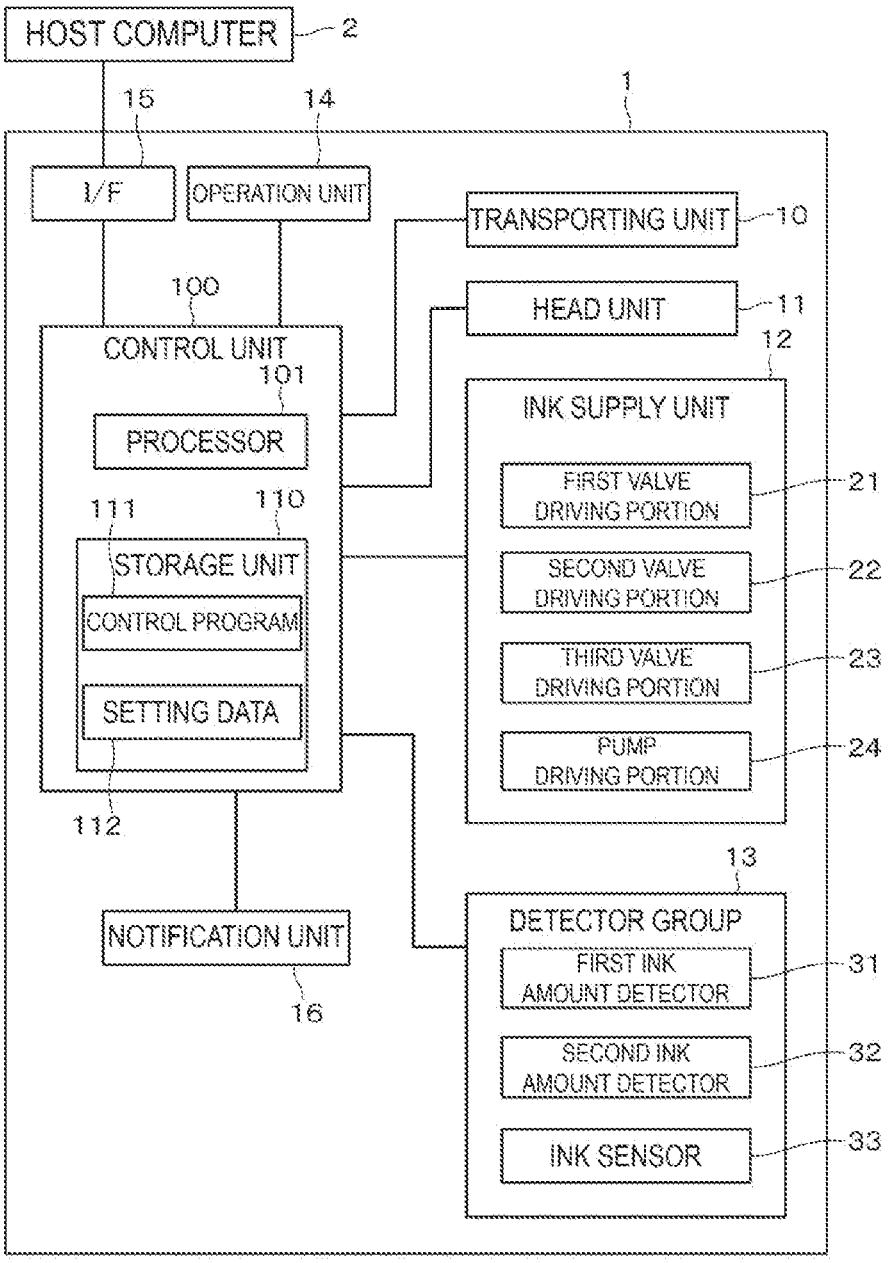
FIG. 3 is a block diagram of a control system for the printer.

FIG. 3 is a block diagram illustrating a configuration of a control system of the printer 1.

The printer 1 includes a control unit 100 that controls each unit of the printer 1. The control unit 100 includes a processor 101 that executes a program, and a storage unit 110. The processor 101 is an arithmetic processing unit composed of a CPU (Central Processing Unit), a DSP (Digital Signal Processor), a microcomputer, etc. The processor 101 may be configured by a plurality of hardware, or may be configured by a single processor. The processor 101 may be a hardware programmed to implement the functions of each unit described below. In other words, the processor 101 may have a configuration in which a control program 111 is installed as a hardware circuit. In this case, for example, the processor 101 is configured by an ASIC (Application Specific Integrated Circuit) or a FPGA (Field Programmable Gate Array).

In the following description, an example of a configuration will be described in which the processor 101 executes the control program 111 to implement various functions of the control unit 100.

The storage unit 110 has a storage region for storing a program to be executed by the processor 101 and data processed by the processor 101. The storage unit 110 stores the control program 111 executed by the processor 101 and configuration data 112 including various configuration values for operation of the printer 1. The storage unit 110 includes a non-volatile storage region that stores programs and data in a non-volatile manner. The storage unit 110 may include a volatile storage region, and may constitute a work area that temporarily stores programs executed by the processor 101 and data to be processed.

A transporting unit 10, a head unit 11, an ink supply unit 12, a detector group 13, an operation unit 14, an interface 15, and a notification unit 16 are coupled to the control unit 100. The transporting unit 10 includes the feeding roller 43, the transport rollers 45, 46, a motor (not illustrated) driving the winding roller 48, etc. as illustrated in FIG. 1. The transporting unit 10 transports the printing medium M in accordance with the control of the control unit 100.

The head unit 11 includes the printing head 41, discharges ink by the printing head 41 in accordance with the control of the control unit 100, and forms an image on the printing medium M.

The ink supply unit 12 operates the ink supply mechanism 50 in accordance with the control of the control unit 100 to supply ink to the printing head 41. The ink supply unit 12 includes a first valve driving portion 21, a second valve driving portion 22, a third valve driving portion 23, and a pump driving portion 24. The first valve driving portion 21 is a driving portion that opens and closes the valve 71, the second valve driving portion 22 is a driving portion that switches the switching unit 73, and the third valve driving portion 23 is a driving portion that opens and closes the valve 76. The valves 71, 74, 75, and 76 can be configured by an electric valve that opens and closes by the power of a motor (not illustrated), or an electromagnetic valve that opens and closes by a solenoid. In this case, the first valve driving portion 21 and the second valve driving portion 22 are configured by a motor or a solenoid. The valve 76 may be configured with a check valve that does not require a power source. The third valve driving portion 23 is configured in the same manner as the first valve driving portion 21, while when the valve 76 is a check valve, the third valve driving portion 23 is omitted.

The pump driving portion 24 includes the main pump 72 and a motor that drives the auxiliary pump 77, etc., and operates the main pump 72 and the auxiliary pump 77, respectively, in accordance with the control of the control unit 100.

The detector group 13 includes various sensors for detecting the operation of the printer 1. For example, the detector group 13 may include a residue sensor for detecting a residual amount of the printing medium M wound on the feeding roller 43, and a medium sensor for detecting the presence or absence of the printing medium M at a detection position upstream of and/or downstream from the platen 42, etc. Further, the detector group 13 may include various sensors for detecting the clogging of the nozzles of the printing head 41. The printing head 41 may include a rotary encoder that detects a transport amount of the printing medium M.

As an example of sensors included in the detector group 13, FIG. 3 illustrates the first ink amount detector 31, the second ink amount detector 32, and an ink sensor 33. As illustrated in FIG. 2, the first ink amount detector 31 is a unit that detects the ink amount in the auxiliary tank 53. The second ink amount detector 32 is a unit that detects the ink amount of the head supply tank 54. The ink sensor 33 is a sensor for detecting the residual ink amount of the ink pack 52 mounted in the main storage unit 51, and includes, for example, the main storage unit ink sensor 85 illustrated in FIG. 2. The detector group 13 outputs a signal indicative of the detected value of the sensor to the control unit 100 at a timing specified by the control unit 100 or at a preset period.

The operation unit 14 includes an operator and a touch panel that accept operation by a user of the printer 1. When the operation by the user is accepted, the operation unit 14 outputs a signal indicative of the operation content to the control unit 100.

The interface 15 is coupled to an apparatus external to the printer 1. In the present exemplary embodiment, a host computer 2 is coupled to the interface 15. The host computer 2 outputs, to the interface 15, data of an image to be printed by the printer 1 and control data including a print instruction for the printer 1. The interface 15 may be, for example, a wired interface unit including a connector connecting the cable and an interface circuit. The interface 15 may be a wireless communication interface that performs wireless data communication with the host computer 2.

The notification unit 16 executes notification in accordance with the control of the control unit 100. The notification unit 16 includes, for example, a liquid crystal display panel, and displays characters and images indicating the notification content. The notification unit 16 may include an LED (Light Emitting Diode) indicator, and may be configured to illuminate or flash the LED in accordance with the control of the control unit 100. The notification unit 16 may include a speaker and a voice output circuit, and may be configured to output a notification sound in accordance with the control of the control unit 100.

Figure 4:
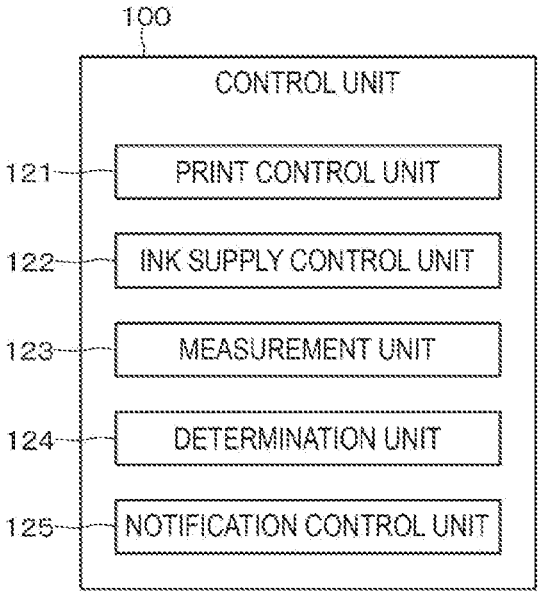
FIG. 4 is a functional block diagram of a control unit.

FIG. 4 is a functional block diagram of the control unit 100.

The control unit 100 includes a print control unit 121, an ink supply control unit 122, a measurement unit 123, a determination unit 124, and a notification control unit 125. As described above, each of these units is realized by the cooperation between the software and the hardware, for example, by the processor 101 executing the control program 111.

The print control unit 121 drives the transporting unit 10 and the head unit 11 based on data input from the host computer 2 via the interface 15, and performs printing on the printing medium M.

The ink supply control unit 122 controls the ink supply unit 12 to supply ink to the printing head 41. The ink supply control unit 122 executes control for determining the settling state of the ink at a predetermined timing. In this case, the ink supply control unit 122 adjusts the ink amount of the auxiliary tank 53 to the second target amount L2, and supplies the ink to the auxiliary tank 53 up to the first target amount L1.

The measurement unit 123 measures a time. In the process of determining the settling state of the ink, the measurement unit 123 measures a time required for the ink amount of the auxiliary tank 53 to change from the second target amount L2 to the first target amount L1.

The determination unit 124 determines the settling state of the ink based on the time measured by the measurement unit 123.

The notification control unit 125 executes notification by the notification unit 16 based on the determination result of the determination unit 124.

4. Determination of Ink Settling State

Figure 5:
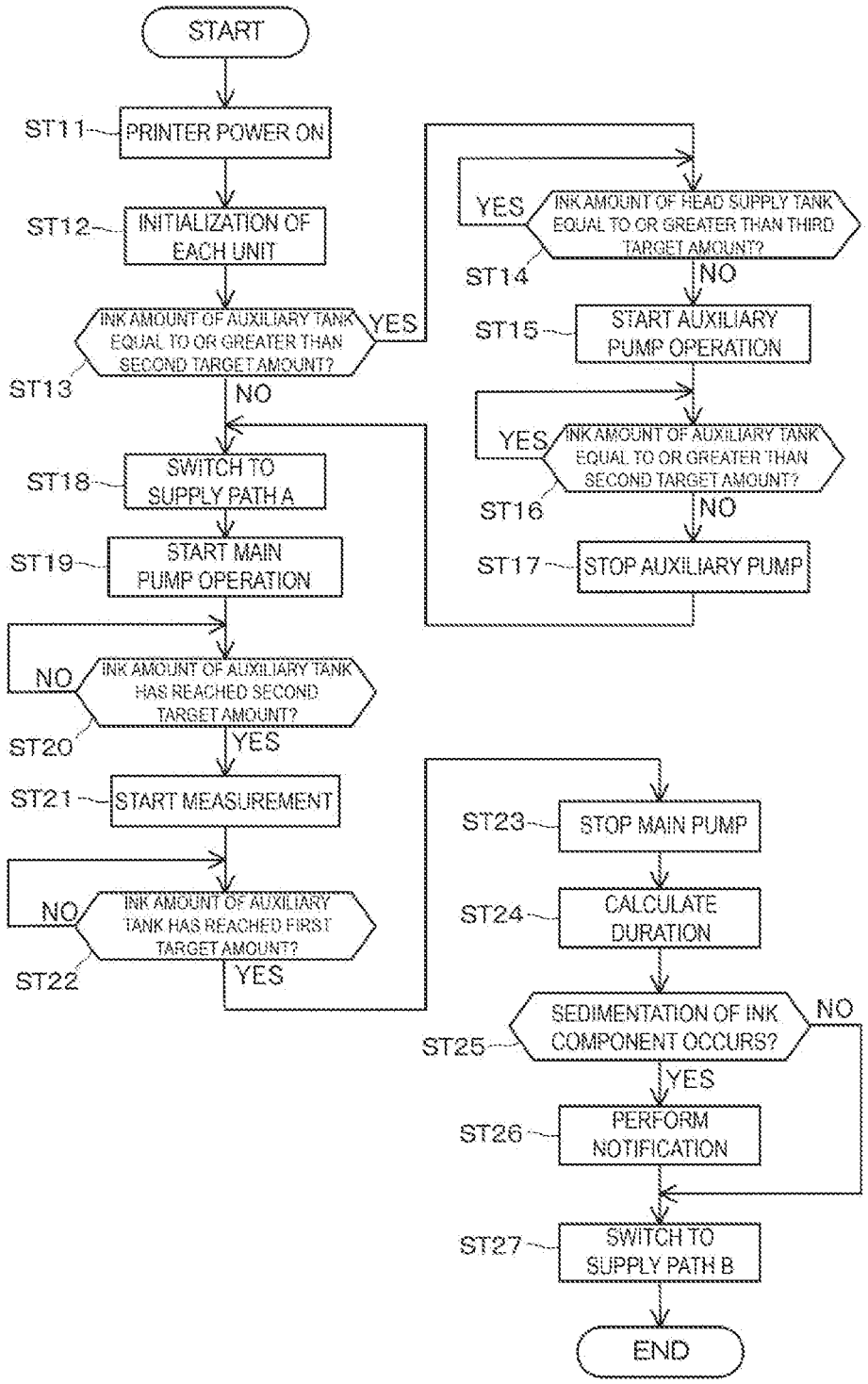
FIG. 5 is a flowchart illustrating operation of the printer.

FIG. 5 is a flowchart illustrating operation of the printer 1, and illustrates a determination process for determining the settling state of the ink.

In the example illustrated in FIG. 5, the control unit 100 of the printer 1 executes the determination process when the printer 1 is powered on. Operation of steps ST13-ST20 and ST22-ST23 are performed by the ink supply control unit 122. Operation of steps ST24, ST25 are executed by the determination unit 124 Operation of step ST26 is executed by the notification control unit 125.

When the printer 1 is turned on (step ST11), the control unit 100 initializes each unit of the printer 1 (step ST12). In step ST12, the control unit 100 executes, for example, initialization of various sensors constituting the detector group 13, detection of an initial position of the motor, etc. The control unit 100 detects the ink amount in the auxiliary tank 53 by the first ink amount detector 31, and determines whether or not the ink amount is equal to or greater than the second target amount L2 (step ST13). In step ST13, the control unit 100 determines whether or not the ink is detected at the detection position of the second target amount L2 by, for example, the second sensor 82.

When the ink amount of the auxiliary tank 53 is equal to or greater than the second target amount L2 (step ST13; YES), the control unit 100 determines whether or not the ink amount of the head supply tank 54 is equal to or greater than the third target amount L3 (step ST14). In other words, the third sensor 83 determines whether or not the ink is detected at the detection position of the third target amount L3.

Here, when the ink amount is equal to or greater than the third target amount L3 (step ST14; YES), the control unit 100 repeats the determination in step S14 at a predetermined period and waits until negative determination is made in step ST14. During this time, for example, the ink amount in the head supply tank 54 is decreased by the printer 1 performing maintenance or printing of the printing head 41. In other words, in a case where there is no free capacity capable of receiving ink in the head supply tank 54, the control unit 100 waits until the ink amount of the head supply tank 54 decreases.

When the ink amount of the head supply tank 54 is less than the third target amount L3 (step ST14; NO), the control unit 100 starts the operation of the auxiliary pump 77 (step ST15). As a result, the ink is transported from the auxiliary tank 53 to the head supply tank 54. During the operation of the auxiliary pump 77, the control unit 100 determines whether or not the ink amount in the auxiliary tank 53 is equal to or greater than the second target amount L2 (step ST16). In step ST16, the control unit 100 determines whether or not the ink is detected at the detection position of the second target amount L2 by, for example, the second sensor 82. When the ink amount is equal to or greater than the second target amount L2 (step ST16; YES), the control unit 100 repeats the determination of step ST16 every predetermined time. When the ink amount is less than the second target amount L2 (step ST16; NO), the control unit 100 stops the auxiliary pump 77 (step ST17) and proceeds to step ST18. When it is determined in step ST13 that the ink amount is less than the second target amount L2 (step ST13; NO), the control unit 100 proceeds to step ST18.

In step ST18, the control unit 100 switches the path of supplying ink from the ink supply tube 91 to the supply path A by the switching unit 73 (step ST18). Subsequently, the control unit 100 starts operation of the main pump 72 (step ST19). During the operation of the main pump 72, the control unit 100 determines whether or not the ink amount in the auxiliary tank 53 has reached the second target amount L2 (step ST20). The determination of step ST20 is performed similarly to step ST16. When the ink amount does not reach the second target amount L2 (step ST20; NO), the control unit 100 repeats the determination of step ST18 every predetermined time. In a case where the ink amount is the second target amount L2 (step ST20; YES), the case means that the ink amount in the auxiliary tank 53 has increased to reach the second target amount L2. At this time, the control unit 100 starts measuring the time by the measurement unit 123 (step ST21). During measurement, the control unit 100 detects the ink amount of the auxiliary tank 53 by the first ink amount detector 31, and determines whether or not the ink amount has reached the first target amount L1 (step ST22). The control unit 100 determines whether or not, for example, the first sensor 81 detects the ink at the detection position of the first target amount L1. When the ink amount does not reach the first target amount L1 (step ST22; NO), the control unit 100 repeats the determination of step ST21 every predetermined time.

When the ink amount reaches the first target amount L1 (step ST22; YES), the control unit 100 stops the main pump 72 (step ST23). The control unit 100 calculates a duration required for the ink amount to increase from the second target amount L2 to the first target amount L1 (step ST24). Based on the time calculated in step ST24, the control unit 100 determines the settling state of the ink (step ST25).

When it is determined that the sedimentation of the ink component has occurred due to the determination of the settling state of the ink (step ST25; YES), the control unit 100 executes notification by the notification unit 16 (step ST26) and proceeds to step ST27. The notification of step ST26 is, for example, a content that indicates to the user that sedimentation of the ink component has occurred, and a content for guiding the stirring of the ink in the ink pack 52. When it is determined that no sedimentation of the ink component occurred (step ST25; NO), the control unit 100 proceeds to step ST27 without executing the notification. In this case, the control unit 100 may notify that there is no sedimentation of the ink component by the notification unit 16.

In step ST27, the control unit 100 switches the path of supplying ink from the ink supply tube 91 to the supply path B (step ST27) by the switching unit 73, and terminates the process.

5. Ink Supply During Printing

Figure 6:
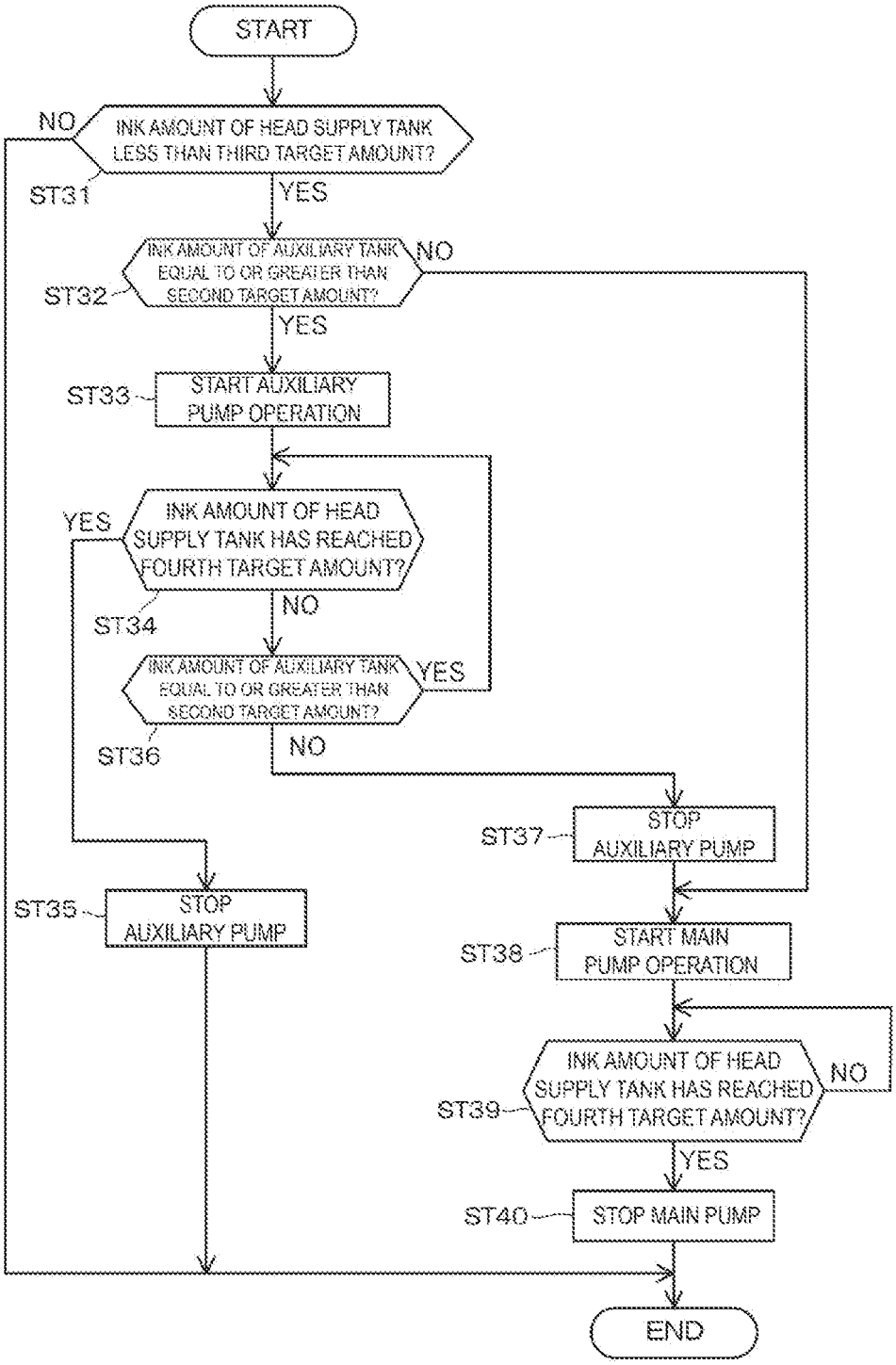
FIG. 6 is a flowchart illustrating operation of the printer.

FIG. 6 is a flowchart illustrating operation of the printer 1, and illustrates control over the supply of ink in a state in which the printer 1 is capable of performing a printing operation. For example, the operation in FIG. 6 is performed while the printer 1 executes printing based on control data and image data transmitted by the host computer 2 to the printer 1. The operation of FIG. 6 is performed by, for example, the ink supply control unit 122.

The control unit 100 detects the ink amount of the head supply tank 54 by the second ink amount detector 32, and determines whether or not the ink amount is less than the third target amount L3 (step ST31). In step ST31, the control unit 100 determines whether or not the third sensor 83 detects ink at the detection position of the third target amount L3, for example.

When the ink amount is equal to or greater than the third target amount L3 (step ST31; NO), the control unit 100 terminates the process. The control unit 100 executes the operation of FIG. 6 at a predetermined period.

When the ink amount of the head supply tank 54 is less than the third target amount L3 (step ST31; YES), the control unit 100 detects the ink amount in the auxiliary tank 53 by the first ink amount detector 31. The control unit 100 determines whether or not the ink amount is equal to or greater than the second target amount L2 (step ST32). The determination of step ST32 is performed similarly to step ST16, for example.

When the ink amount in the auxiliary tank 53 is less than the second target amount L2 (step ST32; NO), the control unit 100 proceeds to step ST38 described below.

When the ink amount in the auxiliary tank 53 is equal to or greater than the second target amount L2 (step ST32; YES), the control unit 100 starts the operation of the auxiliary pump 77 (step ST33). During operation of the auxiliary pump 77, the control unit 100 determines whether or not the ink amount of the head supply tank 54 has reached the fourth target amount L4 (step S34). In step ST34, the control unit 100 determines whether or not the ink is detected at the detection position of the fourth target amount L4 by, for example, the fourth sensor 84.

When the ink amount reaches the fourth target amount L4 (step ST34; YES), the control unit 100 stops the auxiliary pump 77 (step ST35) and terminates the process.

When the ink amount of the head supply tank 54 does not reach the fourth target amount L4 (step ST34; NO), the control unit 100 determines whether or not the ink amount of the auxiliary tank 53 is equal to or greater than the second target amount L2 (step ST36). The determination is performed similarly to step ST36, step ST16.

In step ST36, when the ink amount of the auxiliary tank 53 is equal to or greater than the second target amount L2 (step ST36; YES), the control unit 100 returns to step ST34 to repeat the determination in steps ST34 and ST36 every predetermined time.

When the ink amount of the auxiliary tank 53 is less than the second target amount L2 (step ST36; NO), the control unit 100 stops the auxiliary pump 77 (step ST37) and proceeds to step ST38.

In step ST38, the control unit 100 starts operation of the main pump 72 (step ST38). During operation of the main pump 72, the control unit 100 determines whether or not the ink amount of the head supply tank 54 has reached the fourth target amount L4 (step ST39). In step ST39, the control unit 100 performs determination similarly to step S34, for example. When the ink amount does not reach the fourth target amount L4 (step ST39; NO), the control unit 100 repeats the determination of step ST39 every predetermined time.

In a case where the ink amount reaches the fourth target amount L4 (step ST39; YES), the case means that the replenishment of the ink to the head supply tank 54 is completed. In this case, the control unit 100 stops the main pump 72 (step ST40), and terminates the process.

The operation of FIG. 6 corresponds to ink replenishment operation for replenishing the head supply tank 54 with ink when the ink in the head supply tank 54 is less than the third target amount L3. Operation of steps ST33-ST36 corresponds to first ink replenishment operation for transporting ink from the auxiliary tank 53 to the head supply tank 54. Operation of steps ST38-ST40 corresponds to second ink replenishment operation for transporting ink from the main storage unit 51 through the bypass tube 95 to the head supply tank 54 when the amount of the ink in the auxiliary tank 53 is less than the second target amount L2.

The control unit 100 supplies the ink stored in the auxiliary tank 53 to the head supply tank 54 in preference over the ink in the main storage unit 51 by switching between the first ink replenishment operation and the second ink replenishment operation. As a result, the ink of the auxiliary tank 53 used to determine the settling state of the ink can be quickly consumed by the printing head 41, whereby ink retention in the auxiliary tank 53 can be prevented. Accordingly, the sedimentation of the ink component in the auxiliary tank 53 can be suppressed, whereby the settling state of the ink can be determined with high precision using the auxiliary tank 53.

As described above, the printer 1 according to the present exemplary embodiment forms an image on the printing medium M, wherein the printer 1 includes the printing head that discharges ink and the main storage unit 51 that stores ink. The printer 1 includes the auxiliary tank 53 for storing ink delivered from the main storage unit 51, disposed in the flow path for transporting ink from the main storage unit 51 to the printing head. The printer 1 includes the head supply tank 54 for storing ink, disposed in the flow path for transporting ink from the auxiliary tank 53 to the printing head. The printer 1 also includes the main pump 72 that transports ink from the main storage unit 51 to the auxiliary tank 53, and the first ink amount detector 31 that detects the amount of the ink stored in the auxiliary tank 53. The printer 1 includes the measurement unit 123 that measures the time required to transport ink, and the control unit 100 that performs the determination process for determining the settling state of the ink stored in the main storage unit 51. In the determination process, the control unit 100 drives the main pump 72 to transport the ink from the main storage unit 51 to the auxiliary tank 53. The control unit 100 measures, by the measurement unit 123, the time required for the amount of the ink stored in the auxiliary tank 53 to reach the first target amount L1, and determines the settling state of the ink based on the time measured by the measurement unit 123.

In the determination process, the control method executed by the control unit 100 of the printer 1 includes driving the main pump 72 to transport the ink from the main storage unit 51 to the auxiliary tank 53. The time required for the amount of the ink stored in the auxiliary tank 53 to reach the first target amount L1 with the transported ink is measured. The determination process is performed to determine the settling state of the ink stored in the main storage unit 51 based on the measured time.

According to the printer 1 and the control method for the printer 1, the settling state of the ink can be determined by using the time required for the ink to be transported to the auxiliary tank 53 and the amount of the ink to reach the first target amount L1 as an index of the viscosity of the ink. As a result, the settling state of the ink in the printer 1 can be determined while the ink can be supplied to the printing head 41. For example, it is possible to determine whether or not the sedimentation of the ink occurs without removing the ink pack 52 from the printer 1 or without removing the ink from the ink supply mechanism 50.

The printer 1 includes the notification unit 16. The control unit 100 causes the notification unit 16 to execute the notification in accordance with the determination result of the settling state of the ink based on the time measured by the measurement unit 123. This allows the user to know the settling state of the ink, whereby the user can handle, for example, agitating the ink.

In the printer 1, the control unit 100 executes the determination process when the printer 1 is powered on and printer 1 is activated. As a result, it is possible to determine whether or not the sedimentation of the ink component has occurred during the period when the printer 1 is powered off.

In the determination process, the control unit 100 measures, by the measurement unit 123, the time required for the amount of the ink in the auxiliary tank 53 to reach the first target amount L1 from the second target amount L2 that is less than the first target amount L1. When the amount of the ink in the auxiliary tank 53 detected by the first ink amount detector 31 is different from the second target amount L2 upon starting the determination process, the control unit 100 performs the determination process after adjusting the amount of the ink in the auxiliary tank 53 to the second target amount L2. As a result, after the ink amount in the auxiliary tank 53 is adjusted to the second target amount L2, the duration required for the ink amount to increase from the second target amount L2 to the first target amount L1 is measured. For example, the control unit 100 operates the auxiliary pump 77 to decrease the ink amount to an amount less than the second target amount L2 when the ink amount in the auxiliary tank 53 is equal to or greater than the second target amount L2. When the amount of the ink in the auxiliary tank 53 is less than the second target amount L2, the control unit 100 operates the main pump 72 to supply ink to the auxiliary tank 53, and performs the measurement after the amount of the ink reaches the second target amount L2. As a result, the duration required for the ink amount to change from the second target amount L2 to the first target amount L1 can be accurately measured.

The printer 1 includes the auxiliary pump 77 for transporting the ink from the auxiliary tank 53 to the head supply tank 54. Upon starting the determination process, the control unit 100 detects the amount of the ink in the auxiliary tank 53 detected by the first ink amount detector 31. When the amount of the ink is equal to or greater than the second target amount L2, the amount of the ink in the auxiliary tank 53 is decreased to the second target amount L2 with the transported ink from the auxiliary tank 53 to the head supply tank 54 by the second transport unit. As a result, the duration required for the ink amount of the auxiliary tank 53 to change from the second target amount L2 to the first target amount L1 can be more accurately measured.

Upon starting the determination process, the control unit 100 detects the amount of the ink in the auxiliary tank 53 detected by the first ink amount detector 31. When the amount of the ink is less than the second target amount L2, the main pump 72 transports the ink from the main storage unit 51 to the auxiliary tank 53, thereby increasing the amount of the ink in the auxiliary tank 53 to the second target amount L2. As a result, the duration required for the ink amount of the auxiliary tank 53 to change from the second target amount L2 to the first target amount L1 can be more accurately measured.

The printer 1 includes the bypass tube 95 that couples the main storage unit 51 and the head supply tank 54, and the second ink amount detector 32 that detects the amount of the ink in the head supply tank 54. The printer 1 can transport the ink from the main storage unit 51 to the head supply tank 54 by the main pump 72. In a case where the amount of the ink in the head supply tank 54 is less than the third target amount L3, the control unit 100 performs the ink replenishment operation for transporting the ink to the head supply tank 54. The ink replenishment operation includes the first ink replenishment operation for transporting the ink from the auxiliary tank 53 to the head supply tank 54 when the amount of the ink in the auxiliary tank 53 is equal to or greater than the second target amount L2. The ink replenishment operation includes the second ink replenishment operation for transporting the ink from the main storage unit 51 through the bypass tube 95 to the head supply tank 54 when the amount of the ink in the auxiliary tank 53 is less than the second target amount L2.

As a result, the ink can be appropriately supplied to the head supply tank 54 while the printer 1 executes printing. Further, the first ink replenishment operation and the second ink replenishment operation can be performed, for example, so that the first ink replenishment operation can be performed to rapidly consume the ink from the auxiliary tank 53 used to determine the settling state of the ink by the printing head 41. Thus, the ink retention in the auxiliary tank 53 can be prevented. Therefore, the sedimentation of the ink component in the auxiliary tank 53 can be suppressed, and the accuracy of determining the settling state of the ink using the auxiliary tank 53 can be increased.

The printer 1 includes the switching unit 73 that switches between the bypass tube 95 and the path toward the auxiliary tank 53 as a path for transporting ink from the main storage unit 51. The control unit 100 performs the following operations in the second ink replenishment operation. That is, in a case where it is detected that the amount of the ink in the auxiliary tank 53 has reached the second target amount L2 before it is detected that the amount of the ink in the head supply tank 54 has reached the fourth target amount L4, the switching unit 73 switches to the bypass pipe 95. The fourth target amount L4 is an amount greater than the third target amount L3. Until the second ink amount detector 32 detects that the amount of the ink in the head supply tank 54 has reached the fourth target amount L4, the control unit 100 transports the ink from the main storage unit 51 to the head supply tank 54. As a result, when the ink is supplied to the head supply tank 54, the ink stored in the auxiliary tank 53 can be preferentially transported to the head supply tank 54, which allows for preventing the ink retention in the auxiliary tank 53. When the amount of the ink in the auxiliary tank 53 is less than the second target amount L2, the ink is supplied from the main storage unit 51 to the head supply tank 54 without passing through the auxiliary tank 53. As a result, the ink retention in the auxiliary tank 53 can be more reliably prevented.

In the printer 1, the ink amount M2 corresponding to the difference between the fourth target amount L4 and the third target amount L3 is greater than the ink amount M1 corresponding to the difference between the first target amount L1 and the second target amount L2. Thus, in step ST31, if the amount of the ink in the head supply tank 54 is equal to or less than the third target amount L3, the ink stored in the auxiliary tank 53 can be accommodated in the head supply tank 54. The ink transported from the auxiliary tank 53 to the head supply tank 54 is at most the ink amount M1. The ink amount M2, which is the capacity of the head supply tank 54, is greater than the ink amount M1. As a result, the ink can be transported from the auxiliary tank 53 to the head supply tank 54, and the ink amount retained in the auxiliary tank 53 can be reliably reduced. Therefore, by performing the ink replenishment operation, a majority of the ink stored in the auxiliary tank 53 can be transported to the head supply tank 54, thereby making it possible to more reliably prevent the ink retention in the auxiliary tank 53.

6. Other Exemplary Embodiments

The above-described exemplary embodiment illustrates one aspect of the present disclosure, and can be arbitrarily modified and applied without departing from the spirit of the present disclosure.

For example, the exemplary embodiment described above illustrated the configuration in which, for the ink amount detected by the first ink amount detector 31, the control unit 100 determines whether the amount is equal to or greater than the first target amount L1, or less than the first target amount L1. Similarly, the ink amount in the auxiliary tank 53 was determined to be equal to or greater than the second target amount L2 or less than the second target amount L2, and further the ink amount detected by the second ink amount detector 32 was similarly determined. These are merely examples of a specific embodiment, and the control unit 100 may determine, for example, whether the ink amount is greater than the first target amount L1, or equal to or less than the first target amount L1. The same applies to the second target amount L2, the third target amount L3, and the fourth target amount L4.

In the exemplary embodiment described above, a configuration has been described in which, after performing the notification in step ST26, the process is terminated by switching to the supply path B in step ST27. Here, a step of transporting the ink stored in the auxiliary tank 53 to the head supply tank 54 may be added between step ST26 and step ST27. Specifically, the same determination as in step ST31 described above is made, and when no positive determination is made, the process waits. In a case where the positive determination is made, the auxiliary pump 77 is driven in the same manner as in step ST33. After the operation of the auxiliary pump 77 is started, operations similar to steps ST34, ST36, ST37 are performed. Additionally, in a case where the positive determination is made in step ST34, that is, in a case where the ink amount of the head supply tank 54 is determined to be the fourth target amount L4, it is sufficient to wait a predetermined time after the auxiliary pump 77 is stopped, and the same determination as that in step ST31, i.e., the ink amount of the head supply tank 54 may be determined. Then, when the ink amount in the auxiliary tank 53 is less than the second target amount L2, the auxiliary pump 77 is stopped and the process proceeds to step ST27. In this example, after determining the settling state of the ink, there is an advantage that the ink retention in the auxiliary tank 53 can be more reliably prevented by rapidly ejecting the ink stored in the auxiliary tank 53. For example, after performing the operation illustrated in FIG. 5, even when the time has passed until the start of printing, the ink retention in the auxiliary tank 53 can be prevented. Furthermore, by performing the operation described above, when the printer 1 is powered on next time, the ink stored in the auxiliary tank 53 becomes less than the second target amount L2. Thus, when the operation illustrated in FIG. 5 is started, the operation for reducing the amount of the ink stored in the auxiliary tank 53 to be less than the second target amount can be omitted, whereby the determination process for determining the settling state of the ink can be performed quickly.

Furthermore, the configuration of the printer 1 described above is merely a specific example. For example, the number of the ink packs 52 mounted in the main storage unit 51 and the specific configuration for transporting ink from the main storage unit 51 can be modified as desired. The number of colors of the ink used in the printer 1 and the number of printing heads 41 can be also modified as appropriate. In addition, in the configuration of the printer 1 illustrated in FIG. 1, a configuration is available in which a drying apparatus for drying the ink, an ultraviolet irradiation apparatus for irradiating the ink with ultraviolet light to cure the ink, etc. may be disposed in the transport path of the printing medium M. The other configurations of the printer 1 may also be modified accordingly.

What is claimed is:

1. A printing apparatus configured to form an image on a printing medium, the printing apparatus comprising:

a printing head configured to discharge ink;

a first ink storage unit configured to store the ink;

a second ink storage unit disposed in a flow path configured to transport ink from the first ink storage unit to the printing head, and store the ink delivered from the first ink storage unit;

a third ink storage unit disposed in a flow path configured to transport the ink from the second ink storage unit to the printing head, and store the ink;

a first transport unit configured to transport the ink from the first ink storage unit to the second ink storage unit;

a first detector configured to detect an amount of the ink stored in the second ink storage unit;

a measurement unit configured to measure a time required to transport the ink; and a control unit configured to perform a determination process for determining a settling state of the ink stored in the first ink storage unit, wherein the control unit is configured to drive, in the determination process, the first transport unit to transport the ink from the first ink storage unit to the second ink storage unit, measure, by the measurement unit, a time required for the amount of the ink stored in the second ink storage unit to reach a first target amount, and determine the settling state of the ink based on a time measured by the measurement unit.

2. The printing apparatus according to claim 1, comprising a notification unit, wherein the control unit is configured to cause the notification unit to perform notification in accordance with a determination result of the settling state of the ink based on the time measured by the measurement unit.

3. The printing apparatus according to claim 1, wherein the control unit is configured to execute the determination process when the printing apparatus is powered on and the printing apparatus is activated.

4. The printing apparatus according to claim 1, wherein the control unit is configured to:

measure, in the determination process, by the measurement unit, a time required for the amount of the ink in the second ink storage unit to reach the first target amount from a second target amount, the second target amount being less than the first target amount; and perform the determination process after adjusting the amount of the ink in the second ink storage unit to the second target amount, when the amount of the ink in the second ink storage unit detected by the first detector is different from the second target amount upon starting the determination process.

5. The printing apparatus according to claim 4, comprising a second transport unit configured to transport the ink from the second ink storage unit to the third ink storage unit, wherein when the amount of the ink in the second ink storage unit detected by the first detector is equal to or greater than the second target amount upon starting the determination process, the control unit is configured to transport, by the second transport unit, the ink from the second ink storage unit to the third ink storage unit to decrease the amount of the ink in the second ink storage unit to the second target amount.

6. The printing apparatus according to claim 4, wherein when the amount of the ink in the second ink storage unit detected by the first detector is less than the second target amount upon starting the determination process, the control unit is configured to transport, by the first transport unit, the ink from the first ink storage unit to the second ink storage unit to increase the amount of the ink in the second ink storage unit to the second target amount.

7. The printing apparatus according to claim 6, comprising a bypass path configured to couple the first ink storage unit and the third ink storage unit, and a second detector configured to detect an amount of the ink in the third ink storage unit, wherein the first transport unit is configured to transport the ink from the first ink storage unit to the third ink storage unit, the control unit is configured to, when the amount of the ink in the third ink storage unit is less than the third target amount, perform ink replenishment operation for transporting the ink to the third ink storage unit, and the ink replenishment operation includes first ink replenishment operation for transporting, when the amount of the ink in the second ink storage unit is equal to or greater than the second target amount, the ink from the second ink storage unit to the third ink storage unit, and second ink replenishment operation for transporting, when the amount of the ink in the second ink storage unit is less than the second target amount, the ink from the first ink storage unit through the bypass path to the third ink storage unit.

8. The printing apparatus according to claim 7, comprising a switching mechanism configured to, as a path for transporting the ink from the first ink storage unit, switch between the bypass path and a path to the second ink storage unit, wherein in the second ink replenishment operation, the control unit is configured to:

switch to the bypass path by the switching mechanism, when the first detector detects that the amount of the ink in the second ink storage unit reached the second target amount before the second detector detects that the amount of the ink in the third ink storage unit reached a fourth target amount greater than the third target amount; and transport the ink from the first ink storage unit to the third ink storage unit until the second detector detects that the amount of the ink in the third ink storage unit reaches the fourth target amount.

9. The printing apparatus according to claim 8, wherein an amount of the ink corresponding to a difference between the fourth target amount and the third target amount is greater than an amount of the ink corresponding to a difference between the first target amount and the second target amount.

10. A control method for a printing apparatus, the method comprising:

controlling the printing apparatus including a printing head configured to discharge ink, a first ink storage unit configured to store the ink, a second ink storage unit disposed in a flow path configured to transport ink from the first ink storage unit to the printing head, and store the ink delivered from the first ink storage unit, a third ink storage unit disposed in a flow path configured to transport the ink from the second ink storage unit to the printing head, and store the ink, a first transport unit configured to transport the ink from the first ink storage unit to the second ink storage unit, and a first detector configured to detect an amount of the ink stored in the second ink storage unit;

driving the first transport unit to transport the ink from the first ink storage unit to the second ink storage unit;

measuring a time required for the amount of the ink stored in the second ink storage unit to reach a first target amount with the transported ink; and performing a determination process for determining, based on the measured time, a settling state of the ink stored in the first ink storage unit.

* * * * *